US005785310A

United States Patent [19]

Köhn

[11] Patent Number: 5,785,310

[45] Date of Patent: Jul. 28, 1998

[54] DEVICE FOR DECOLLATING STACKS OF FLAT OBJECTS

[75] Inventor: Uwe Köhn, Osnabrück, Germany

[73] Assignee: Windmöller & Hölscher, Lengerich/Westf., Germany

[21] Appl. No.: 671,762

[22] Filed: Jun. 28, 1996

[30] Foreign Application Priority Data

Jul. 7, 1995 [DE] Germany ..... 195 24 878.3
Oct. 26, 1995 [DE] Germany ..... 195 39 935.8

[51] Int. Cl.[6] ..... B65H 5/08

[52] U.S. Cl. ..... 271/13; 271/12; 271/10.07; 271/101; 271/35; 271/225; 271/226; 271/265.01; 271/276

[58] Field of Search ..... 271/12, 13, 10.07, 271/35, 101, 148, 151, 184, 185, 190, 198, 197, 216, 225, 226, 275–277, 265.01

[56] References Cited

U.S. PATENT DOCUMENTS

| | | | |
|---|---|---|---|
| 4,082,456 | 4/1978 | Schroter | 198/415 X |
| 4,127,262 | 11/1978 | Eberle et al. | 271/12 |
| 5,069,440 | 12/1991 | Lazzarotti et al. | 198/415 X |
| 5,106,070 | 4/1992 | Reist | 271/12 |

FOREIGN PATENT DOCUMENTS

| | | | |
|---|---|---|---|
| 1 536 489 | 12/1969 | Germany . | |
| 3208425A1 | 9/1983 | Germany . | |
| 3214342A1 | 10/1983 | Germany . | |
| 2732591C2 | 1/1986 | Germany . | |
| 48344 | 5/1981 | Japan | 271/227 |
| 96246 | 5/1987 | Japan | 271/227 |
| 244847 | 10/1987 | Japan | 271/226 |
| 26640 | 2/1991 | Japan | 271/226 |
| 2235436 | 3/1991 | United Kingdom | 271/198 |

*Primary Examiner*—Boris Milef
*Attorney, Agent, or Firm*—Evenson, McKeown, Edwards & Lenahan, PLLC

[57] ABSTRACT

A device for decollating stacks of flat objects includes a stack magazine. The base of the stack magazine supports the stack and includes revolving rollers that form a continuously moving series of rollers, pass underneath the stack magazine, and roll along the lowest object of the stack. A conveyor system is arranged underneath the upper run of the series of rollers and extends at an angle to the series of rollers. The lowest object that is removed from the stack by one passing roller is deposited on the conveyor system. A suction device moves or suction devices move between the rollers in the cycle in which the rollers pass underneath the magazine. The suction device or devices pulls or pull down one lateral edge of the lowest object between two rollers. The leading roller still supports the stack via the object and the trailing roller passes between the object and the object situated above so as to cause a secure separation of the lowest object from the stack. In order to transfer the decollated objects from the first conveyor to the transfer conveyor such that their lateral edges extend parallel to the transport direction, the transferring conveyor system includes conveyor elements that move in parallel and are driven at different speeds.

9 Claims, 4 Drawing Sheets

DEVICE FOR DECOLLATING STACKS OF FLAT OBJECTS

BACKGROUND OF THE INVENTION

1. Field of the Invention

This invention pertains to a device for decollating stacks of flat objects such as tubular segments that are processed into bags.

2. Description of Related Art

Rotary sheet feeders, such as those disclosed in DE-OS 1,536,489, DE-OS 3,208,425 and DE-OS 3,214,342, are typically used for decollating flat objects that are arranged in stacks. These rotary sheet feeders consist of rotatable suction rollers that are arranged in rotating drums. While passing underneath a stack that is supported by the drum, the suction rollers take hold of the front edge of the lowest object of the stack and separate the object from the stack. The object decollated in this way is then deposited on a conveyor. However, the decollating of stacks by means of such rotary sheet feeders is quite problematic at high decollating speeds because the stack supported on the rotating drum of the rotary sheet feeder may begin to vibrate such that it is no longer ensured that the lowest object of the stack is securely held by the suction rollers.

Stacks of flat objects can be decollated at high speeds with a device of the initially mentioned type such as that which is known from DE-2,732,591 C2. However, in this known device, it is difficult to deposit the decollated, rectangular objects on the conveyor such that its lateral edges are aligned parallel to the transport direction. This is because the lateral edge, or part of the lateral edge, taken hold of by the suction roller or the suction rollers is deposited on the conveyor at a time at which part of the object still adjoins the underside of the stack. Consequently, it is possible for the decollated object to be deposited on the conveyor in a misaligned fashion such that the object is not deposited on the conveyor parallel to the transport direction. It is unlikely that an object can be deposited on the conveyor parallel to the transport direction if the conveyor extends at an acute angle to the moving series of rollers as disclosed in DE-2,732,591 C2.

SUMMARY OF THE INVENTION

Consequently, the present invention is based on the objective of developing a device of the initially mentioned type in which the decollated, rectangular objects can be deposited on the conveyor such that their lateral edges extend parallel to the transport direction of the conveyor.

According to the invention, this objective is attained by realizing a device of the initially mentioned type in accordance with certain characteristics. Due to the different speeds of the two conveyor elements, the misalignment of the objects that are removed from the stack and deposited on the conveyor can be compensated. This is realized by turning the decollated objects, with the aid of the two conveyor elements that are driven at different speeds, into a position in which they extend parallel to the moving direction of the conveyor that is divided into two suction belt conveyors.

According to a preferred embodiment, it is proposed that the conveyor system consist of two suction belt conveyors. The suction belt conveyor on which the lateral edge of the respective object is deposited is driven at a slower speed than the other suction belt conveyor on which the part of the object that is ultimately removed from the stack is deposited.

The conveyor that transports the decollated objects may extend at an angle to the moving series of rollers. However, the conveyor that transports the decollated objects preferably extends perpendicular to the moving series of rollers.

According to a preferred embodiment, it is proposed that the speeds of both suction belt conveyors can be adjusted separately such that the position in which the decollated objects extend parallel to the conveyor can be adjusted depending on the speed of the moving series of rollers and the speed of the suction belt conveyor. It is practical if the speeds of both suction belt conveyors can be variably adjusted during the operation of the device.

According to an additional development of the invention, it is proposed that both suction belt conveyors extend only over such a distance that the edges of the rectangular objects transported by the conveyors are aligned parallel to the transport direction. After this alignment, the decollated objects are preferably transferred to a second conveyor on which the objects can no longer be misaligned.

It is practical if the speeds of both suction belt conveyors are adapted to one another in such a way that the objects reach the common transfer end of both suction belt conveyors with their edges aligned parallel to the transport direction. This measure ensures that the decollated objects can be transferred to the second conveyor in the properly aligned position.

According to an additional development of the invention, it is proposed that the second conveyor belt that revolves at a higher speed is arranged directly following the first conveyor belt that consists of two divided suction belt conveyors. The deflection roller situated on the feed side of the second conveyor belt may cooperate with a pressing roller that can be lowered onto the aforementioned deflection roller, with the pressing roller being controlled in such a way that the objects are removed from the first conveyor belt at intervals such that the properly aligned introduction into downstream processing stations and the precisely timed adaptation to the machine cycle of said processing stations is ensured.

A control device is provided for controlling the pressing roller. From signals generated by a sensor that detects the front edge of the ensuing object as well as signals of a signal transmitter which indicate the proper position of this objects on the second conveyor belt, this control device determines the respective intervals at which the pressing roller is lowered.

This signal transmitter can consist of a sensor that detects the angular position of the deflection roller that is situated on the feed side of the second conveyor belt and generates signals in accordance with rotating index markings that are uniformly distributed over its circumference.

One particular problem in decollating objects from stacks by means of suction devices that take hold of or pull down the lowest object of a stack arises if these objects are flat, tubular segments that are taken hold of at their cut edges. These suction devices only take hold of the lower wall of the tubular segment while the upper wall may still be in contact with the stack. Naturally, this type of decollating by means of suction devices can result in significant problems.

So-called staggered tubular segments are frequently utilized in the manufacture of bags from tubular segments. In these staggered tubular segments, the upper tube wall overlaps the lower tube wall at one cut edge. One such staggered tubular segment consisting of single-layered paper is, for example, known from U.S. Pat. No. 421,191. According to an inventive refinement, it is proposed that the suction device take hold of the upper tube wall that overlaps the lower tube wall so as to securely decollate stacks of staggered tubular segments, namely with a suction device that takes hold of one edge of the lowest tubular segment of the stack so as to remove said object from the stack.

Staggered tubular segments can also consist of multi-layered side walls, with the individual layers of the side walls being arranged in such a way that they successively overlap. If multi-layered staggered tubular segments are to be decollated, the suction device preferably also takes hold of at least part of the upper paper layer of the upper tube wall.

BRIEF DESCRIPTION OF THE DRAWINGS

Embodiments of the invention are described in detail below with reference to the figures.

DESCRIPTION OF THE PREFERRED EMBODIMENT

Figure 1:
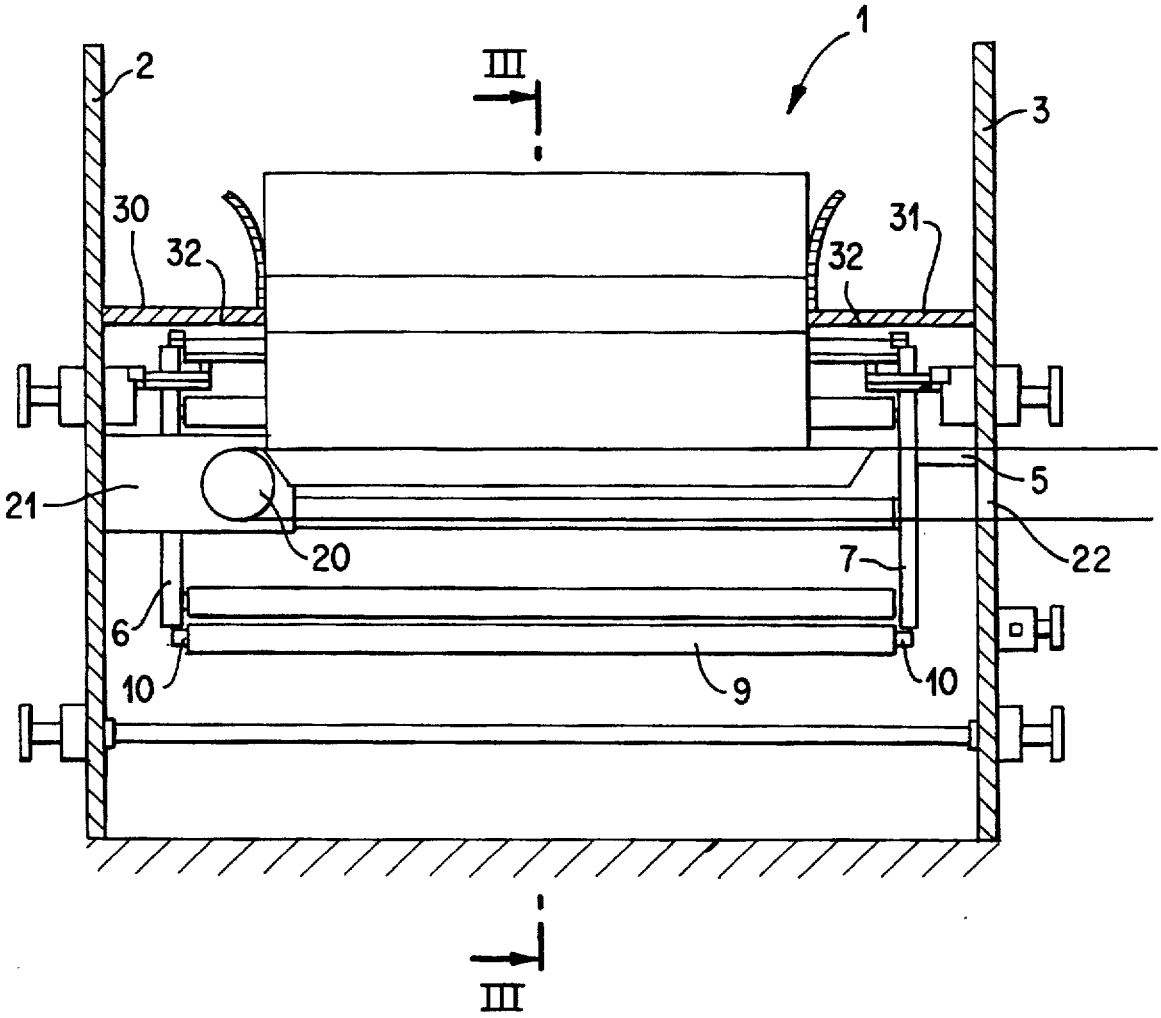
FIG. 1 is a section through the decollating device along the line I—I in FIG. 3.

The decollating device 1 consists of a machine frame with lateral parts 2, 3. Guideways 6, 7 for the rollers 8 revolving thereon are fastened to the inner sides of the aforementioned lateral parts by means of brackets 4, 5. The two guideways 6, 7 that are arranged in parallel respectively consist of upper and lower sections that extend in parallel and are connected by means of approximately semicircular sections. The ends of the rollers 8 that are guided on the guideways 6, 7 and arranged in parallel uniform spaced distances are fastened to endless chains or drawgears. These chains or drawgears move in guides, not shown, and are driven by drive units, not shown. The rollers 8 consist of cylindrical pipe sections that are arranged on axles in freely rotatable fashion. The axle journals 10 of these axles are fastened to the chains or drawgears that move the axles along the guideways 6, 7.

The upper run 11 of the rollers that revolve on endless chains or drawgears along the guideways 6, 7 form a moving series of rollers, above which a cassette 12 that forms a stack magazine is held on the lateral parts 2, 3. This cassette serves to accommodate stacks of tubular paper segments 13 that, after being decollated, are processed into paper bags in processing stations arranged downstream. The cassette 12 has four side walls, at least one side wall 14 of which can be adjusted, by means of a manually actuated spindle drive, to different tubular segment formats in the direction indicated by the double arrow.

The base of the stack cassette 12 is formed by the upper run 11 of the moving series of rollers.

A conveyor belt 16 consisting of two suction belt conveyors 17, 18 that extend adjacent to one another in parallel fashion is arranged underneath the upper run 11 of the moving series of rollers, namely between the upper run and the lower run of the moving series of rollers. The conveyor belt 16 extends perpendicular to the moving direction of the series of rollers.

Figure 2:
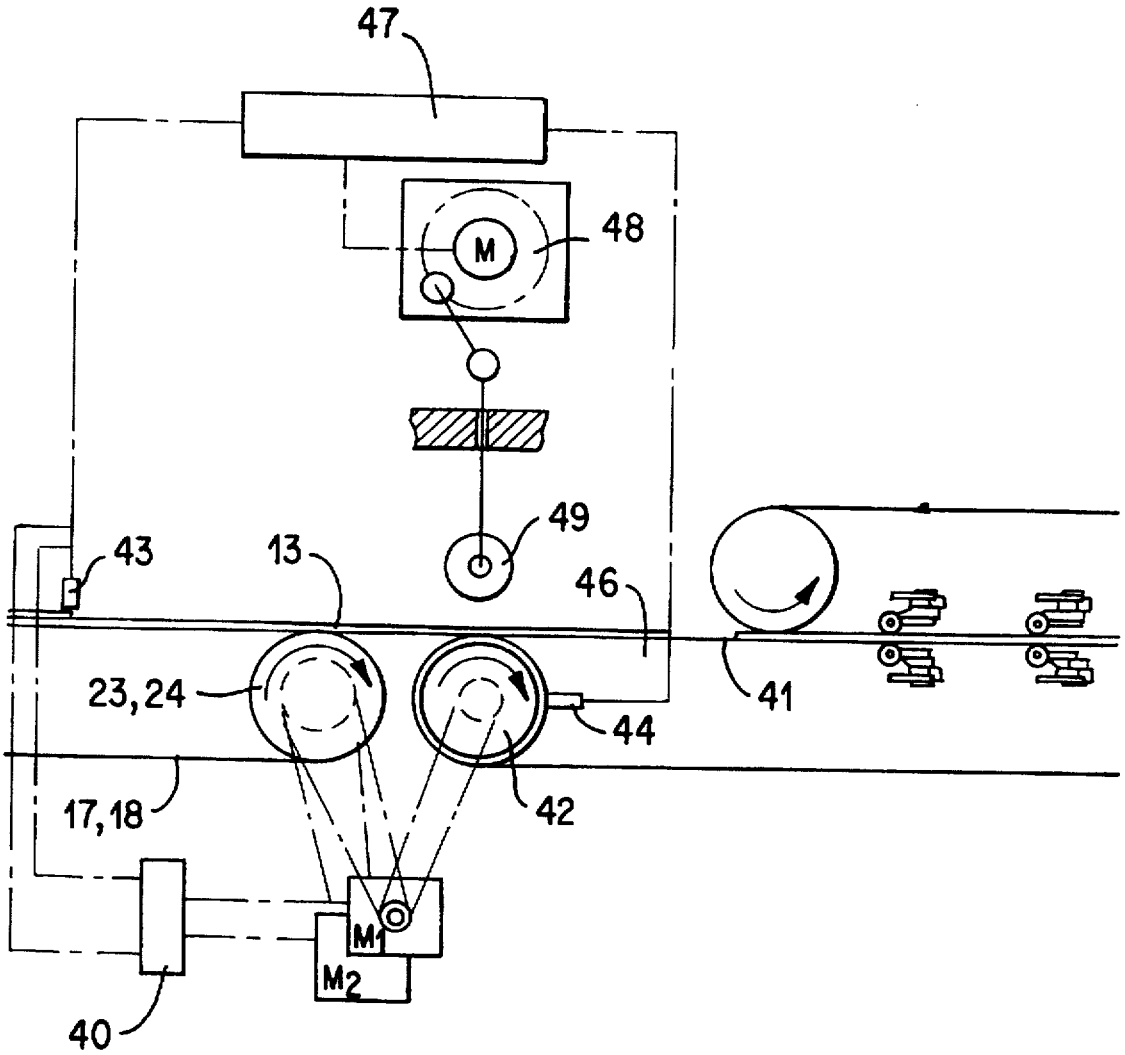
FIG. 2 is a view of the right part of the conveyor belt that extends underneath the upper run of the grate of rollers as well as the second conveyor belt arranged directly behind the first conveyor belt.

The front deflection rollers 20 of both suction belt conveyors 17, 18 that extend adjacent to one another in parallel fashion are arranged on consoles 21 that are fastened to the lateral frame 2. The endless conveyor belts 17, 18 extend through a rectangular, window-like cutout 22 in the lateral frame 3 and move over the driven deflection rollers 23, 24 that form the feed ends and are arranged in the machine frame in not-shown fashion. The deflection rollers 23, 24 are driven at different speeds by means of controlled gear motors M1 and M2 as schematically indicated in FIG. 2.

Figure 3:
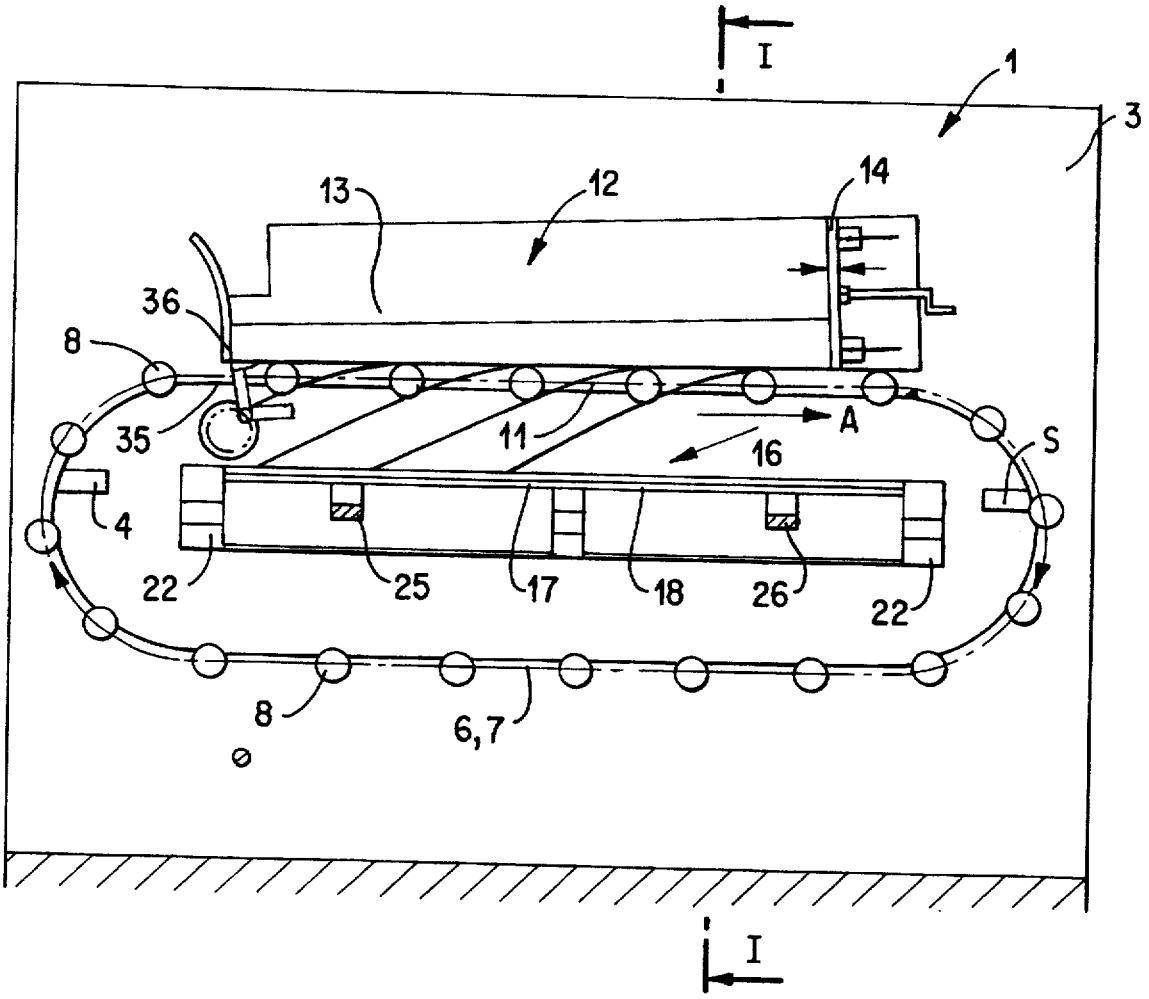
FIG. 3 is a section through the decollating device along the line III—III in FIG. 1.

The endless conveyor belts 17, 18 that are provided with corresponding rows of perforations extend over suction boxes 25, 26 that are fastened to the lateral parts 2, 3 in a manner not shown and extend over at least the length of the stack cassette 12 and underneath it, as shown in FIGS. 1 and 3.

The series of rollers moves underneath the stack cassette 12 in the direction of the arrow A. The plate-shaped side opposing walls of the stack cassette are carried by plates 30, 31. The undersides of the plates are provided with a coating 32 that increases the friction. The lateral end regions of the freely rotatable sleeves of the rollers 8 which consist of pipe sections are pressed against the aforementioned coatings during their passage under the cassette such that they begin to rotate. The rollers adjoin the lowest tubular segment stacked in the cassette 12 as shown in FIG. 3.

After the arrival of one respective roller 8 underneath the cassette 12, two suction devices 35 that can be raised and lowered and are laterally arranged on the left end region of the cassette shown in FIG. 3 take hold of the lower front edge 6 of the lowest tubular segment which, according to FIG. 3, is situated on the left. These suction devices pull the tubular segment downward behind the leading roller 8 and in front of the trailing roller 8 such that the trailing roller 8 is moved into the wedge-shaped gap between the front edge of the tubular segment being pulled down and the accordingly exposed end region of the ensuing tubular segment, which is subsequently pulled down in corresponding fashion, namely in the cycle of the suction devices that move up and down.

Figure 4:
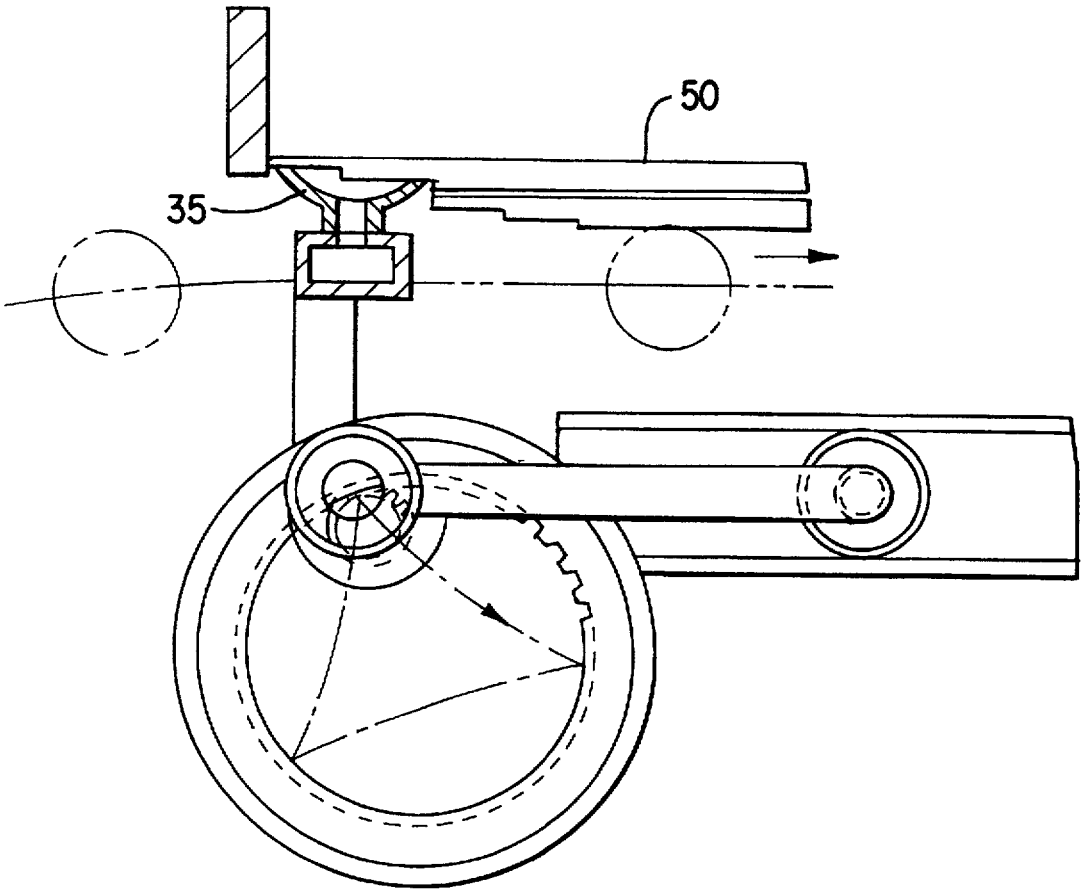
FIG. 4, a section through the suction device that respectively takes hold of the lower front edge of the objects to be removed from the stack as well as a schematic representation of its drive unit.

The driving of both suction devices that are raised and lowered in the cycle in which the rollers 8 pass underneath the cassette is schematically illustrated in FIG. 4.

The fashion in which the lowest object is pulled out of the stack cassette and the driving of the suction devices that can be raised and lowered correspond to the figures and the description of DE-2,732,591 C2. In contrast to the devices described in this publication, the decollating device according to the present invention is provided with two suction devices 35 arranged in a pair and simultaneously engage on opposing end regions of the rear edges of the objects to be decollated. The suction devices 35 are connected to vacuum sources in the same fashion as described in DE-2,732,591 C2, with the vacuum sources supplying the suction devices 45 with suction air in the corresponding cycle.

The tubular segments that are successively decollated from the bottom of the stack held in the cassette 12 arrive on the suction belt 17 with their initially removed lateral edge. The part of this tubular segment that still adheres to the stack is increasingly removed from said stack by the passing rollers 8 of the moving series of rollers, until the opposite side is entirely deposited on the other section belt 18. The misalignment of the successively deposited objects is compensated by the different speeds of the suction belt conveyors 17, 18. The suction belt conveyor 17 is driven at a slower speed than the suction belt conveyor 18. The speeds of both suction belt conveyors 17, 18 can be adjusted by means of the separately controlled gear motors M1 and M2.

A computer 40 is provided for controlling the gear motors M1, M2. This computer detects the position of the tubular segments deposited on the suction belt conveyors 17, 18 by means of sensors 43 and, in case of a possibly detected misalignment, controls the gear motors M1, M2 in such a way that the misalignment is compensated for by the different speeds of the suction belt conveyors. Naturally, the speed of the suction belt conveyors can also be manually adjusted by visual inspection.

The decollating device is arranged in front of a so-called bottom applicator of a bag manufacturing machine in which the bottom, for example, the cross bottom, is attached to the cut edges of the sides of the tubular segments. In order to make it possible to process the decollated, traversely conveyed tubular segments without interference, it is necessary to transfer the tubular segments from the suction belt conveyors 17, 18 to the second conveyor belt 41 that forms the feed conveyor for the bottom applicator at intervals that are adapted to the machine cycle of the downstream processing stations, i.e., a precisely timed and positioned introduction of the segments into the downstream processing stations must be ensured.

The front deflection roller 42 of the second conveyor 41 is driven by the gear motor M1 at a higher speed so that the second conveyor belt 41 revolves at a higher speed than the two suction belt conveyors 17, 18. In order to ensure the precisely timed and positioned transfer of the objects conveyed by the suction belt conveyors 17, 18, the suction belts 17, 18 transfer the objects in such a way that the objects move over the driving roller 42 of the conveyor 41 at a time at which the object is still held by the suction boxes 25, 26. The position of the respective front edge of the ensuing object 13 is determined by a sensor 43. A sensor 44 (incremental transmitter) scans the teeth or other index markings arranged on the driving roller 42 of the conveyor 41. The sensor 44 generates signals that indicate the precisely timed passage of one point 46 through the downstream processing device. From the signals of the sensors 43, 44, the computer 47 forms a signal for the drive 48 of a pressing roller 49 that can be raised and lowered. This pressing roller is lowered onto the driving roller 42 in precisely timed fashion, i.e., in the cycle of the downstream processing machine, and causes a frictional connection between the segment 13 and the second conveyor 41 such that each segment 13 is transferred onto the conveyor 41 in precisely timed and positioned fashion.

In the downstream bag manufacturing machine, the tubular segments may be provided with cross bottoms or folded bottoms that are attached to so-called staggered tubular segments.

FIG. 4 shows a graduated tubular segment 50 in the form of an enlarged representation. The walls of this staggered tubular segment comprise three layers, with the individual layers of each side wall also being staggered relative to one another.

In order to prevent only the lower wall of the tubular segment from being removed from the stack magazine, the suction device 35 engages on the layers of the upper tube wall that overlap the layers of the lower tube wall, i.e., the end of the tubular segment which is taken hold of is entirely pulled out of the stack magazine without risking that one of the upper walls remains in the magazine.

What is claimed is:

1. A device for decollating stacks of flat objects that are processed into bags comprising:

a stack magazine having a base which supports a stack, revolving rollers that form a continuously moving series of rollers, pass underneath the stack magazine and roll along a lowermost object in the stack, a conveyor system that is arranged underneath an upper run of the series of rollers and extends at an angle to the series of rollers, the lowermost object being removed from the stack by one passing roller and deposited on said conveyor system, the conveyor system comprising conveyor elements that move in parallel and are driven at different speeds, and at least one suction device that moves between the rollers in a cycle in which the rollers pass underneath the magazine, said at least one suction device pulling down one lateral edge of the lowermost object between two rollers in such a manner that a leading roller still supports the stack via the lowermost object and a trailing roller passes between the lowermost object and an object situated above the lowermost object so as to cause a secure separation of the lowermost object from the stack, characterized by the fact that the conveyor system includes a first conveyor belt comprising two suction belt conveyors, one of said suction belt conveyors on which the lateral edge of the object is deposited being driven at a lower speed than the other suction belt conveyor on which a part of the object that is ultimately removed from the stack is deposited.

2. A device according to claim 1, characterized by the fact that both suction belt conveyors extend perpendicular to the moving series of rollers.

3. A device according to claim 1, characterized by the fact that speeds of both suction belt conveyors of the conveyor system can be adjusted separately.

4. A device according to claim 1, characterized by the fact that the objects are rectangular and both suction belt conveyors extend only over such a distance that the lateral edges of the rectangular objects conveyed by said suction belt conveyors are aligned parallel to the transport direction.

5. A device according to claim 1, characterized by the fact that the speeds of both suction belt conveyors are adapted to one another in such a way that the objects reach a common transfer end of both suction belt conveyors with their edges aligned parallel to the transport direction.

6. A device according to claim 1, and further comprising a second conveyor belt that revolves at a higher speed arranged directly after the two suction belt conveyors.

7. A device according to claim 6, wherein said second coverage belt comprises a deflection roller situated on a feed side of the second conveyor belt, said device further comprising a pressing roller that can be lowered onto said deflection roller, the pressing roller being controlled in such a way that the objects are removed from the first conveyor belt at intervals that ensure a precisely timed and positioned introduction into downstream processing stations.

8. A device according to claim 7, and further comprising a control device provided for controlling the pressing roller, a sensor that detects a front edge of an ensuing object and a signal transmitter that indicates a correct position of this object on the second conveyor belt, said control device determining intervals at which the pressing roller is lowered from signals from said signal transmitter.

9. A device according to claim 8, characterized by the fact that the signal transmitter includes a sensor that detects an angular position of the deflection roller situated on a feed side of the second conveyor belt and generates signals in accordance with rotating index markings that are uniformly distributed over the circumference of the deflection roller.

* * * * *